US007513068B2

(12) United States Patent
Fauver

(10) Patent No.: US 7,513,068 B2
(45) Date of Patent: Apr. 7, 2009

(54) VARIABLE FLEXION RESISTANCE SPORT BOOT

(75) Inventor: William Benjamin Fauver, 813 Deer Foot Ct., Nashville, TN (US) 37221

(73) Assignee: William Benjamin Fauver, Nashville, TN (US)

( * ) Notice: Subject to any disclaimer, the term of this patent is extended or adjusted under 35 U.S.C. 154(b) by 0 days.

(21) Appl. No.: 10/429,324

(22) Filed: May 5, 2003

(65) Prior Publication Data

US 2003/0204971 A1 Nov. 6, 2003

Related U.S. Application Data

(60) Provisional application No. 60/380,040, filed on May 6, 2002.

(51) Int. Cl.
*A43B 7/20* (2006.01)
*A43B 5/04* (2006.01)

(52) U.S. Cl. ..... 36/118.4; 36/115; 36/89; 36/118.7

(58) Field of Classification Search ..... 36/118.3, 36/118.4, 118.5, 118.6, 118.8, 119.1
See application file for complete search history.

(56) References Cited

U.S. PATENT DOCUMENTS 652,936 A 7/1900 Taylor
3,619,914 A * 11/1971 Hanson et al. ..... 36/118.4
3,633,291 A * 1/1972 Caporicci ..... 36/118.8
3,686,778 A * 8/1972 Hornung ..... 36/118.4
3,718,995 A * 3/1973 Graup ..... 36/118.5
3,861,067 A * 1/1975 Koyama et al. ..... 36/118.8
4,455,769 A * 6/1984 Fritsch ..... 36/118.8
4,655,465 A 4/1987 Schaeffer
4,835,885 A 6/1989 Hoshizaki et al.
5,459,949 A 10/1995 MacPhail
5,704,620 A 1/1998 Oliemans et al.
5,727,338 A * 3/1998 George et al. ..... 36/117.6
5,794,362 A 8/1998 Polk, III et al.
5,823,543 A 10/1998 Burns et al.
5,931,480 A 8/1999 Schroeder
5,947,487 A 9/1999 Keleny et al.
5,957,470 A 9/1999 Powell
6,039,329 A 3/2000 Burns et al.
6,217,036 B1 4/2001 Rowledge
6,299,182 B1 10/2001 Powell
6,336,643 B1 1/2002 Wu

* cited by examiner

*Primary Examiner*—Jila M Mohandesi
(74) *Attorney, Agent, or Firm*—Conley Rose, P.C.

(57) ABSTRACT

A sport boot that allows for a reduced resistance plantar extension coupled with a controlled, resistive plantar flexion motion. The preferred embodiments provide a one-piece boot made of a flexible material, such as leather. A triangular portion of the boot material, from a point just posterior to the ankle opening to a larger area anterior of the ankle on both sides of the boot, is cut out. One or more piston assemblies are attached to the boot material on both sides of the cut away portion of the boot. The piston assemblies provide resistance to compression during flexion of the boot but offer no resistance to extension during plantar extension.

14 Claims, 5 Drawing Sheets

FIG. 4.A 30
12
28
45
43
27
24
46
44
26
43
27
46
30

VARIABLE FLEXION RESISTANCE SPORT BOOT

CROSS-REFERENCE TO RELATED APPLICATIONS

The present application claims priority to U.S. Provisional Application No. 60/380,040, filed May 6, 2002, titled "Variable Flexion Resistance Sport Boot," and hereby incorporated herein by reference for all purposes.

STATEMENT REGARDING FEDERALLY SPONSORED RESEARCH OR DEVELOPMENT

Not applicable.

BACKGROUND OF THE INVENTION

This disclosure relates to sport boots, and specifically to sport boots with enhanced abilities to absorb forces from jump landings and maneuvers. Still more specifically, this disclosure relates to sport boots having mechanical devices adapted to resist flexion of the boot at the ankle area.

Sport boots (e.g. an ice skating boot) require several seemingly conflicting elements. For example, they must fit comfortably, provide support laterally, and offer firm support for jump landings. They must also allow pivotal movement of the ankle, as in plantar flexion and plantar extension. In addition, as the skill of an athlete advances, additional support is often desired to assist in increasingly difficult jump landings and other physically demanding maneuvers. Thus, as athletic standards increase, balancing sport boot plantar resistance strength upon landings with boot flexibility has become a more difficult issue to solve.

Currently, sport boot designs offering additional landing strength generally include reinforced materials that are often thicker and stronger in order to support increasingly difficult jumps and movements. Reinforced sport boots designed to withstand those increasingly difficult, and higher, jumps often have flexion characteristics restricting plantar extension movement or calf muscle use in jumping. Further, reinforced leather, or other material, in the ankle area tends to gradually lose its stiffness and support, often prompting replacement of the boot.

Sport boots generally require a break-in period before it reaches optimal performance. The break-in time of a leather sport boot is almost entirely attributed to conditioning the portion of the boot surrounding the ankle, especially in boots reinforced in this area or with especially heavy leather. During this break-in time, wearer discomfort is increased. As sport boots become stronger and stiffer, the break-in period for the boot becomes more substantial. This additional break-in period has a potentially negative effect on training time.

At the other end of sport boot's life is the break-down period, during which the leather loses stiffness and performance drops below the optimum level. The most significant issue to the athletes using this equipment may be soft tissue injuries that are more frequent due to the break-down in the boot materials. Accelerated break-down of the sport boot not only leads to increased equipment costs but further erodes training time and sometimes leads to chronic injuries.

Therefore, the embodiments of the present invention are directed to methods and apparatus for sport boots offering increased flexion resistance that seek to overcome certain of the limitations or drawbacks of the prior art.

SUMMARY OF THE PREFERRED EMBODIMENTS

The preferred embodiments provide a sport boot that allows for a reduced resistance plantar extension coupled with a controlled, resistive plantar flexion motion. The preferred embodiments provide a one-piece boot made of a flexible material, such as leather. A triangular portion of the boot material, from a point just posterior to the ankle opening to a larger area anterior of the ankle on both sides of the boot, is cut out. One or more piston assemblies are attached to the boot material on both sides of the cut away portion of the boot. The piston assemblies provide resistance to compression during flexion of the boot, but offer no resistance to extension during plantar extension.

One embodiment includes, a sport boot comprising a boot body adapted to cover the ankle of a wearer. An aperture is formed through both sides of the boot body proximate to the ankle and one or more pistons connect to the boot body across a portion of the aperture such that the one or more pistons are compressed when the boot body is flexed about the ankle. One or more metal bands may be attached to the boot body where the one or more pistons are connected to the boot body. The aperture though the boot body may preferably form a triangle from a point just posterior of the ankle to a larger area anterior of the ankle on a front edge of the boot body. In certain embodiments, the one or more pistons provide resistance to compression loads while providing no resistance to tension loads. The sport boot may also include a sheath adapted to connect to the boot body and cover the one or more pistons and/or an ice skating blade attached to the boot body.

In another embodiment, a sport boot includes a boot body adapted to cover the ankle of a wearer, an aperture through both sides of the boot body proximate to the ankle, a support system connected to the boot body and adapted to at least partially surround the aperture, and one or more piston members connected to the flexible support system and adapted to compress when the boot body flexes about the ankle. In certain embodiments, the support system includes a hinge proximate to the ankle, an upper band attached to the hinge and disposed on the boot body adjacent to an upper edge of the aperture, and a lower band attached to the hinge and disposed on the boot body adjacent to an upper edge of the aperture, wherein the support system is adapted to absorb at least a portion of the energy from flexion of the boot body about the ankle. The one or more pistons are preferably attached to only one of the upper or lower bands and are compressed when contacted by a plate affixed to the other of the upper or lower bands. One preferred aperture forms a triangle from a point just posterior of the ankle to a larger area anterior of the ankle on a front edge of the boot body. In certain preferred embodiments, the one or more pistons provide resistance to compression loads, but provide no resistance to tension loads. The sport boot may also include a sheath adapted to connect to the boot body and cover the one or more pistons and/or an ice skating blade attached to the boot body.

In another embodiment, a method for supporting a foot and ankle during jumping activities includes providing a boot body having an aperture proximate to the ankle and providing lateral and flexion support to the foot and ankle by attaching one or more piston members to the boot body and disposed across the aperture. The one or more piston members preferably provide flexion support by resisting compression, but do not resist extension. In a preferred embodiment, the amount of flexion support can be adjusted by replacing or adjusting the resistance provided by the one or more pistons.

Thus, the present invention comprises a combination of features and advantages that enable it to provide a sport boot offering variable flexion resistance. These and various other characteristics and advantages of the preferred embodiments will be readily apparent to those skilled in the art upon reading the following detailed description and by referring to the accompanying drawings.

BRIEF DESCRIPTION OF THE DRAWINGS

For a more detailed understanding of the preferred embodiments, reference is made to the accompanying Figures, wherein:

FIGS. 4A and 4B are schematic views of one embodiment of a piston assembly.

DETAILED DESCRIPTION OF THE PREFERRED EMBODIMENTS

Figure 1:
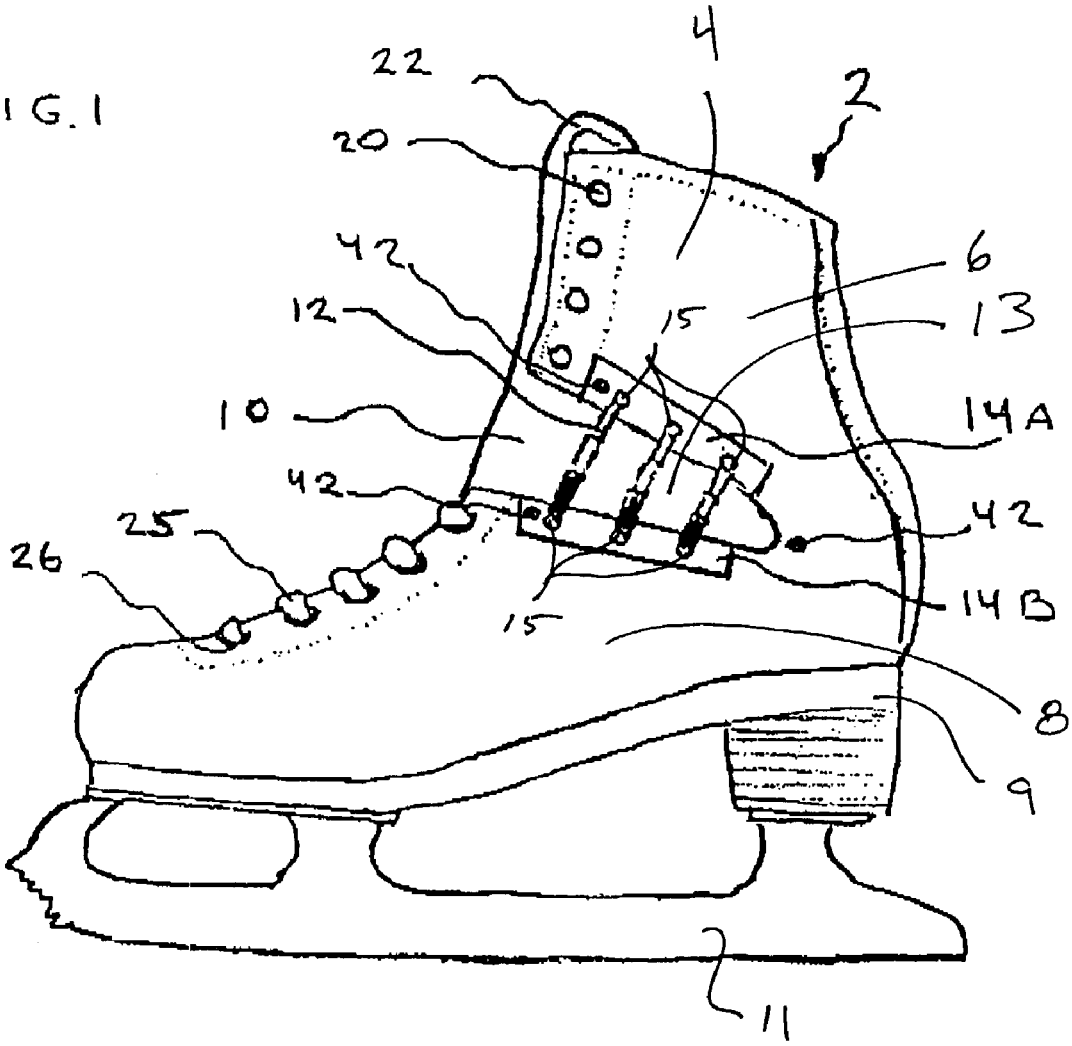
FIG. 1 is an elevation view of one embodiment of a sport boot.

In the description that follows, like parts are marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to those embodiments illustrated and described herein. It is to be fully recognized that the different teachings of the embodiments discussed below may be employed separately or in any suitable combination to produce the desired results.

In particular, various embodiments of the present invention provide a number of different methods and apparatus for providing a sport boot offering variable flexion resistance. The concepts of the invention are discussed in the context of an ice skating boot (e.g. a boot used in figure skating or hockey). However, the use of the concepts of the present invention is not limited to this particular application and may be applied in other sport boot applications, such as, for example, basketball shoes, ski boots, and in-line skates, as well as any other sport that involves jumping. Thus, the concepts disclosed herein may find application in other footwear applications, both within sporting goods and other technologies to which the concepts of the current invention may be applied.

Figure 2:
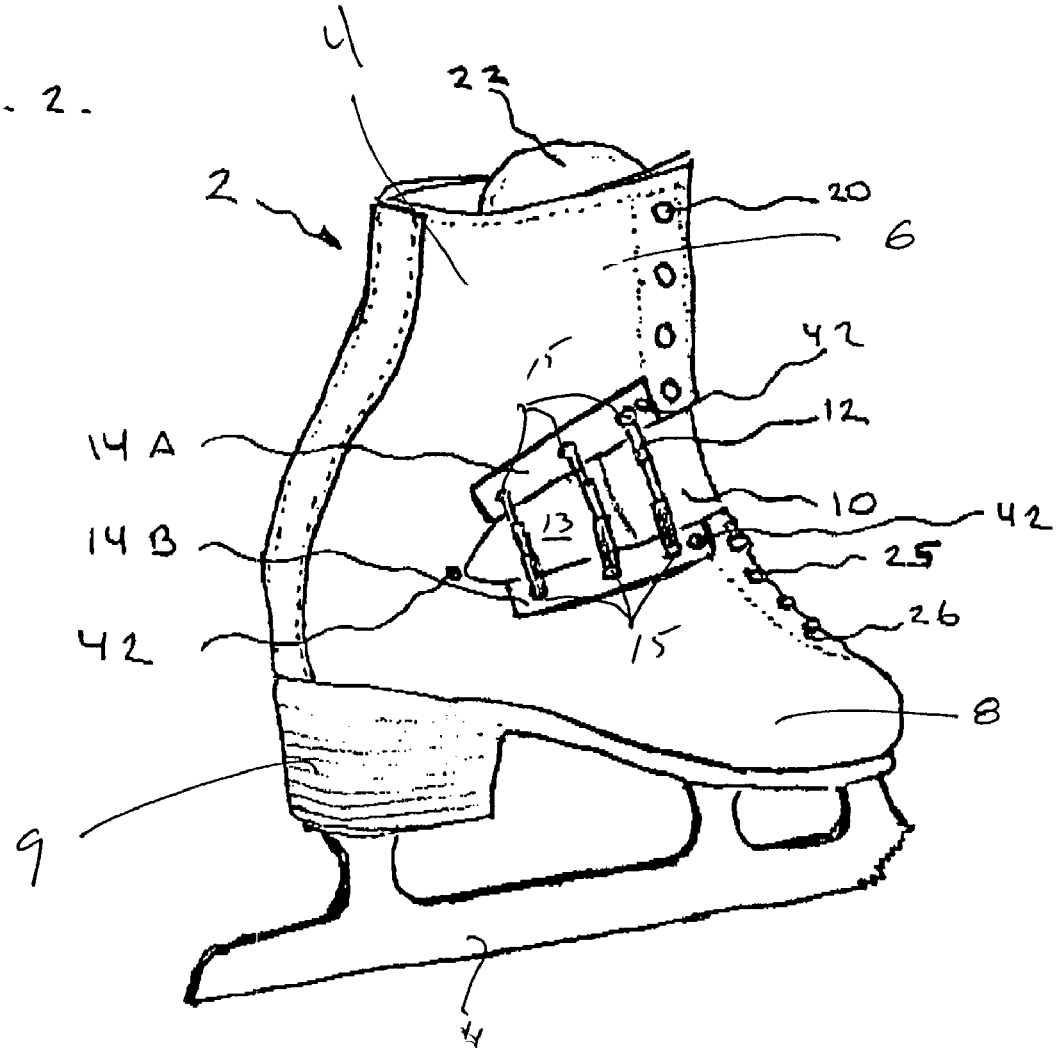
FIG. 2 is a rear view of the sport boot of FIG. 1.

Referring now to FIG. 1 and FIG. 2, the sport boot 2 is in the form of a figure skate but this invention is equally applicable to other forms of sport boots and shoes, as stated above. It is also understood that many types of materials could easily be used to construct this invention in all aspects. This sport boot is designed with many benefits: reduction of soft tissue damage, more freedom of movement and more complete muscle involvement for jumps, selective choice of resistance, better shoe life, reduced break-in or break-down periods, and constant resistance to flexion on landings. Unlike many of the attempts to fix sport boot functionality, this invention keeps the sport boot looking like it currently does, in whatever form it may have, and not oversized with hinges and/or buckles.

Sport boot 2 comprises a boot body 4 having an upper portion 6 and a lower portion 8. Upper portion 6 is adapted to receive the wearers foot, while lower portion 8 includes a sole 9 and any applicable attachment, such as skate 11. The boot body 4 is essentially a one piece, unitary structure, which in some embodiments may be formed of several different components or pieces fastened together. Body 4 includes a cut out portion 10 roughly forming a triangle from a point just posterior of the ankle opening 13 to a larger area anterior of the ankle opening. Cut out portion 10 is on both sides of boot body 4. The cut out portion 10 coincides with the support area for skating movements and jump landings, as well as the area of the boot body 4 that impedes foot extension and buckles under flexion.

In its place, one or more piston assemblies 12 are attached to both sides of the cut out portion 10. The piston assemblies 12 are fastened to both sides of cut out portion 10 with fasteners 15, such as rivets, narrow flat head screws, or other low-profile fastening arrangements. These fasteners 15 go through the body material as well as metal bands 14A, 14B, which form an anchor for the transfer of energy to the boot body 4 from the pistons 12 during movements.

The metal bands 14A, 14B are preferably very thin, such as 1/32" or less, and horseshoe shaped to match the shoe shape. In certain embodiments, bands 14A and 14B may be layered such that the overall strength of the shoe would increase as more layers are added. Bands 14A and 14B may also be constructed of other substantially rigid materials such as plastics, polymers, or other composite materials. Bands 14A, 14B are located on either side of cut out portion 10 at the top of the lower portion 8 and the bottom of upper portion 6. The layered metal bands 14A, 14B assist in the general lateral firmness of the shoe and also spread the load of the pistons 12 out to more of the shoe. The holes on the inside of the reinforcement bands 14A, 14B are preferably beveled such that the screw or fastener 15 is flush to the band inside the shoe.

Figure 3:
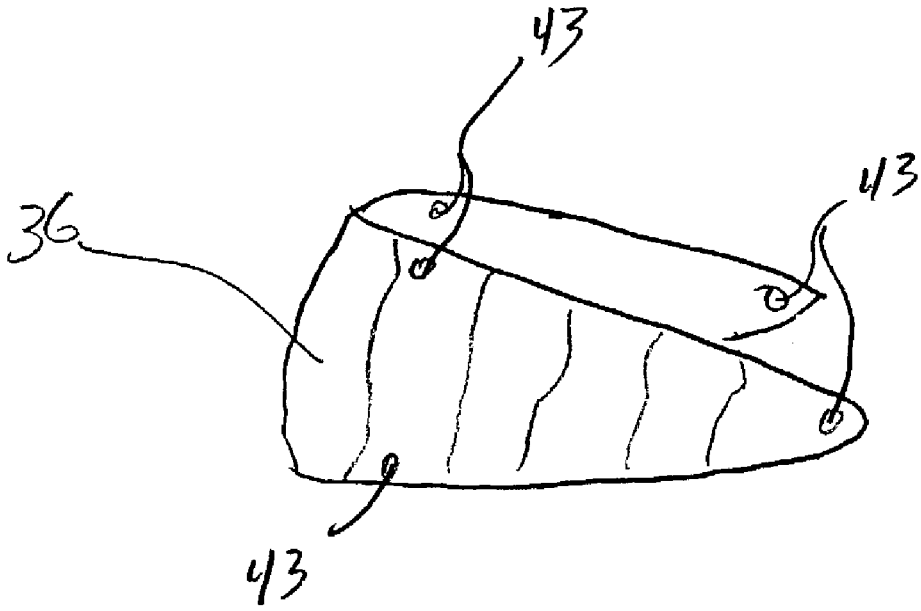
FIG. 3 is one embodiment of a cover component.

A soft nylon sheath 36, as shown in FIG. 3, is preferably disposed on both sides of the shoe and has snaps 43 adapted to connect to fittings 42 on the shoe. Sheath 36 covers the cut out portion 10. The tongue 22 runs from just posterior to the toes up the anterior portion of the foot to just past the top of the shoe. Laces 25 run across the tongue 22 and connect the eyelets 26 and hooks 20 to pull the sides of the shoe portions together.

Figure 4B:
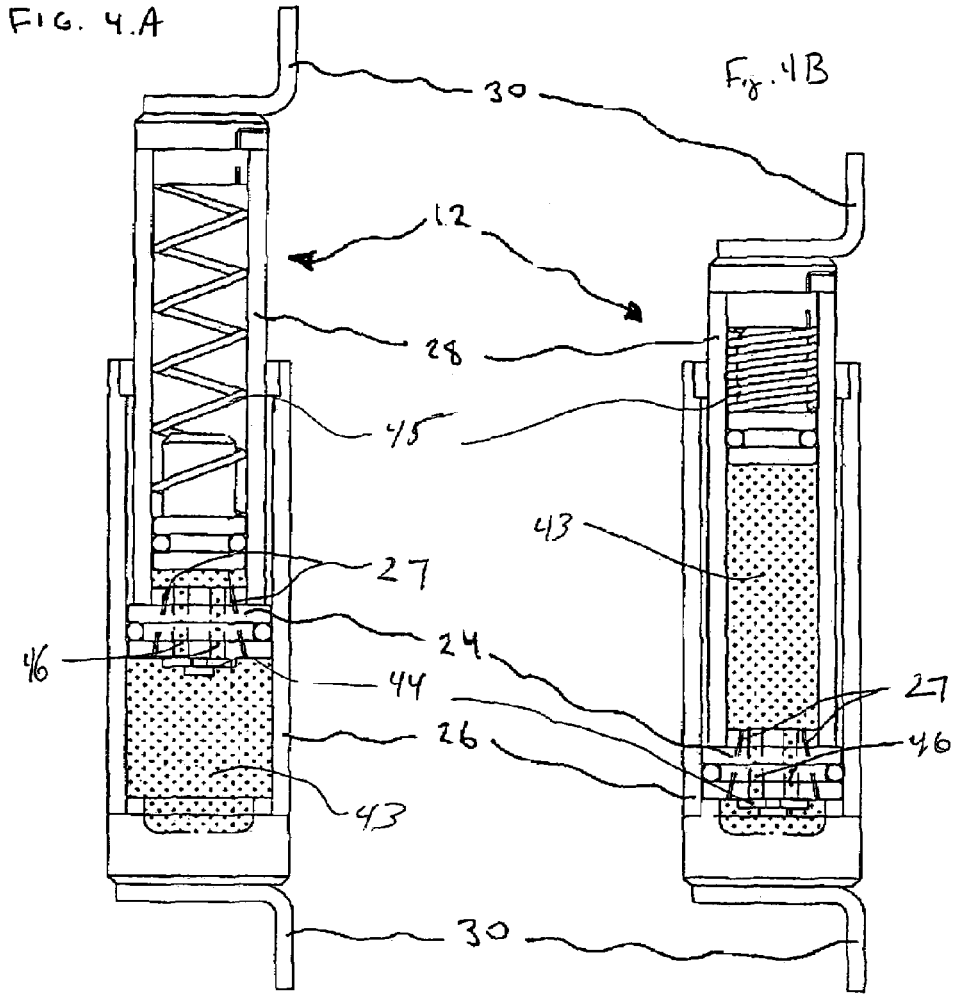

Referring now to FIGS. 4A and 4B, a detailed view of one embodiment of piston 12 is shown in the extended position in FIG. 4A and in the compressed position in FIG. 4B. The piston 12 has two functions for the sport boot, namely giving lateral support to the ankle and providing one-way resistance for support of jump landings. Piston 12 comprises an orifice ring 24 to control flow, a casing 26, and piston body 28. Piston 12 is filled with a fluid 43 and biased to the extended position by spring 45. In addition, piston 12 includes mounting flanges 30 at both ends of the piston 12 where the pistons are connected to the shoe by fasteners.

As piston body 28 moves from the extended position shown in FIG. 4A to the retracted position of FIG. 4B, fluid 43 is pushed from inside casing 26 to inside body 28 through small diameter ports 27. Resilient flapper 44 prevents fluid from flowing through large diameter ports 46. This restricted flow of fluid provides a resistance to the compression of piston body 28. Once the compressive force is released, spring 45 pushes fluid from inside of body 28 into casing 26 through small diameter ports 27 and large diameter ports 46. Flapper 44 allows fluid to flow out of body 28.

FIGS. 4A and 4B show only one embodiment of piston 12 based on one-way restricted movement of fluid and there are a variety of ways to construct the pistons. This invention is not limited to the type of piston shown in FIGS. 4A and 4B. In the preferred embodiments, the pistons 12 are adjustable, such as by varying the diameter of the orifice ring, so as to establish gradients of resistance. Another way to make the pistons 12 vary resistance could be an adjustment ring nut that is twisted to increase or decrease the resistance.

Thus, referring back to FIG. 1, pistons 12 replace the material removed from cut out portion 10 and serve as the support for jumping and other movements such as landings. Because in the prior art this area is often reinforced to provide jump landing support, it also impedes foot extension for jumping and is the greatest problem area in new boots for fit and function. The pistons 12 give lateral support to the ankle and provide one-way resistance for support of jump landings. This design allows more full extension of the foot for jumping and conversely offering adjustable support for jump landings.

Jumping would also be assisted by the increased freedom to use the foot and calf muscles and keep foot contact longer during take-offs. The pistons 12 would preferably be changeable and could have gradients of resistance that are adjustable such that the user could select a support level for jump landings. In addition, these embodiments would not have a significant break-in period since the break-in period relates to the ankle flexibility almost exclusively and since, with these embodiments, the flexing action is metered by the pistons so that the materials that traditionally have had to give and crease won't have to.

In the preferred embodiments, should the athlete desire stronger or weaker landing support they could simply replace the pistons with new pistons with a different rating or possibly adjust the piston's resistance. In addition, there would be no significant break-down period when the boots or sports boots can no longer adequately support the landing loads. In the preferable embodiments, the pistons 12 could easily be changed should they fail, and the material comprising the rest of the sports boot would last a long time since it would not be constantly flexed and stressed from jump landings or flexing. The preferable pistons 12 would be roughly the diameter of a pencil and could be covered by a nylon mesh or other materials to keep the look of a current sport boot.

Figure 5:
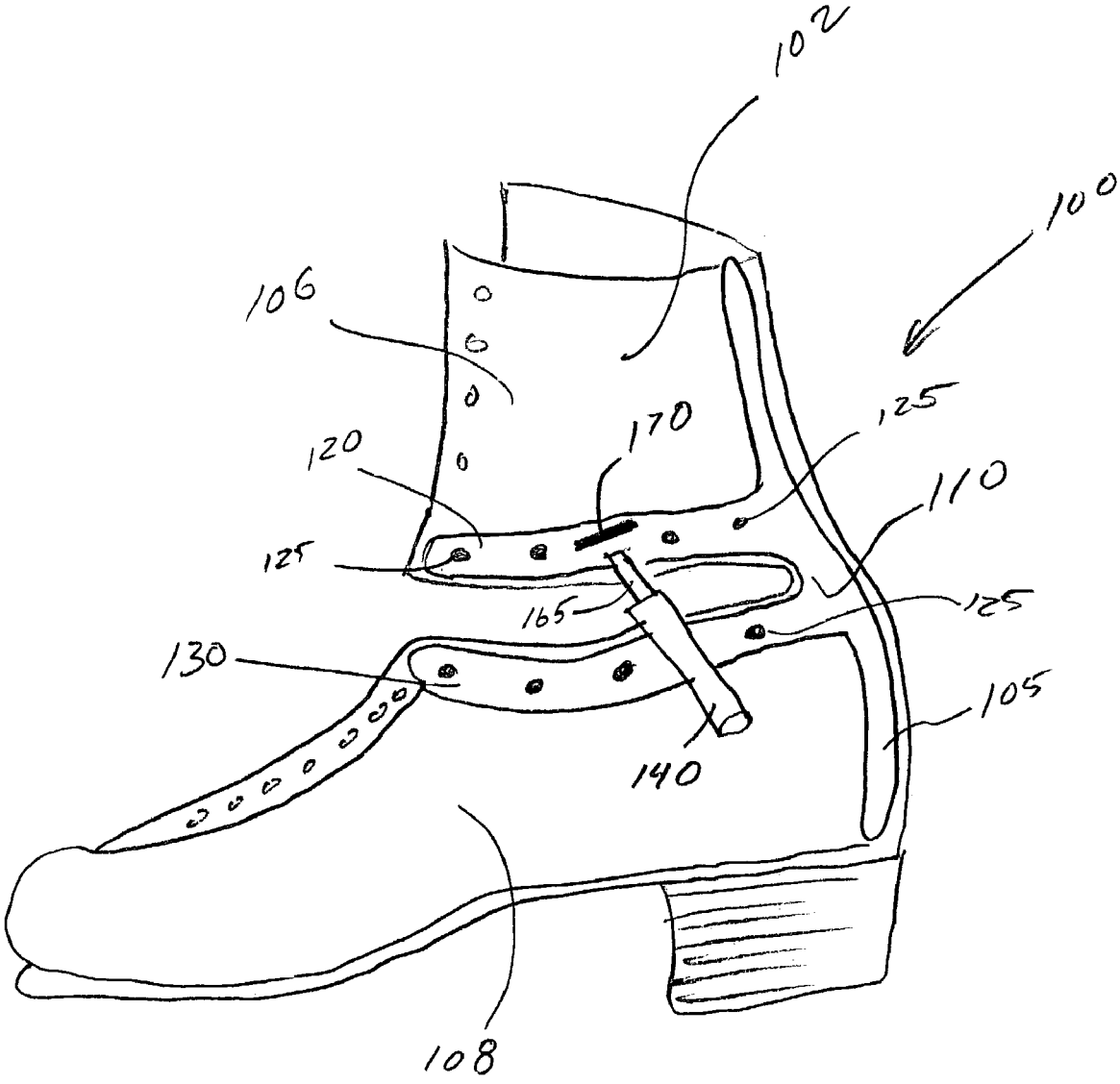
FIG. 5 is an elevation view of one alternative embodiment of a sport boot.

Another embodiment of a sport boot 100 with variable flexion resistance is illustrated in FIG. 5. Sport boot 100 includes boot body 102 having an integrated support apparatus 105 having a hinge 110 located at the posterior end of the unit that gives lateral support to the boot and it is generally located on a horizontal plane with the ankle flexing motion. Support apparatus 105 also includes two semi circular bands 120, 130 that attach to the upper portion 106 and lower portion 108 of the sport boot as well as to the hinge 110 to form an interconnected unit. Hinge 110 may be a mechanical hinge or may just be a point or region in the support apparatus 105 where bending occurs when the boot 100 is flexed.

The support apparatus 105 may be comprised of a variety of materials including polyethylene, polypropylene, vinyl, nylon, steel, plastic, graphite, etc. The thickness and width of the materials comprising apparatus 105 may vary as their individual strength and characteristics also may vary. The upper band 120 and lower band 130 can be attached to boot 100 through a variety of fasteners 125 including rivets, screws or a bonding material forming a strong and secure attachment of the bands 120, 130 to the boot body 102. The bands 120, 130 serve to transfer some of the landing loading to the piston 140 and therefore reduce the loading to the boot body 102 or to the foot itself.

In certain embodiments, the pistons 140 are screwed into the lower band 130 of the support apparatus 105 but could be fastened in many other ways. The upper band 120 has plate bars 170 that will contact the pistons 140 upon plantar flexion. The compression motion of hinge 110 actuates the pistons 140 as they are compressed by contact with the plate bars 170 on piston plungers 165. As the pistons 140 are compressed, they may operate as described in reference to FIG. 4 to create resistance to compression. On plantar extension, the plate bars 170 no longer contact the pistons 140 and the piston plungers 165 are free to return to their extended position as described in reference to FIG. 4.

Thus, the embodiments provide a more consistent and controlled nature of resistance to plantar flexion as well as a greater freedom of plantar extension. An athlete using a device constructed in accordance with these embodiments could expect increased fine motor control of jumps by allowing extended foot positions that more fully utilize leg, calf and foot musculature and sensation resulting in significant reduction in the G-force loads applied upon landings and a corresponding reduction in the incidence of soft tissue damage.

Additionally these embodiments provide other advantages. One such advantage being increased boot life since in other sport boots the material compromising the boot itself is the only landing support system. In these cases the material fatigues and fails at break-down and when new it may be very hard to flex the material at all. So on the one hand you have a new boot that is stiff to flex and hard to use until the material comprising the boot "creases" and then after a length of time this material may break down when worn out and become unusable from the flexing motion, versus a boot with a constant resistance life span where the boot material is not required to flex as a method of support. Since in most sport boots this break-down period usually is when the sport boots are considered unusable, this new system offers a significantly extended usable life of the sport boot. Additionally, since the boots would have a constant plantar flexion characteristic there would be no need for an extended break-in period as is customary. The plantar flex resistance characteristics would be consistent from the first day of use significantly reducing or eliminating a break-in period that further reduces effective training time.

These embodiments also provide the possibility to change the resistance of plantar flexion by adjusting or changing the pistons. The user could decide whether to make the boots stiffer for certain applications or make it softer and more easily "flexed" for others. This system also has the possibility of being retro fitted in some applications and shoe designs.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the present inventive concept, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A sport boot comprising:

a boot body adapted to cover the ankle of a wearer;

an aperture through both sides of said boot body proximate to the ankle;

one or more pistons connected to said boot body such that said one or more pistons are operable to restrict plantar flexion but not restrict plantar extension; and a sheath adapted to connect to said boot body and cover said one or more pistons.

2. The sport boot of claim 1 further comprising one or more metal bands attached to said boot body where said one or more pistons are connected to said boot body.

3. The sport boot of claim 1 wherein said aperture forms a triangle from a point just posterior of the ankle to a larger area anterior of the ankle on a front edge of said boot body.

4. The sport boot of claim 1 wherein said one or more pistons provide resistance to compression loads.

5. The sport boot of claim 4 wherein said one or more pistons provide no resistance to tension loads.

6. The sport boot of claim 1 further comprising an ice skating blade attached to said boot body.

7. A sport boot comprising:

a boot body adapted to cover the ankle of a wearer;

an aperture though both sides of said boot body proximate to the ankle;

a support system connected to said boot body and adapted to at least partially surround said aperture;

one or more piston members connected to said flexible support system and adapted to provide one-way support for plantar flexion without impeding plantar extension; and a sheath adapted to connect to said boot body and cover said one or more pistons.

8. The sport boot of claim 7 wherein said support system further comprises:

a hinge proximate to the ankle;

an upper band attached to said hinge and disposed on said boot body adjacent to an upper edge of said aperture; and a lower band attached to said hinge and disposed on said boot body adjacent to an upper edge of said aperture, wherein said support system is adapted to absorb at least a portion of the energy from flexion of said boot body about the ankle.

9. The sport boot of claim 8 wherein said one or more pistons are only attached to the sport boot at one of said upper or lower bands.

10. The sport boot of claim 9, wherein said one or more pistons are compressed when contacted by a plate affixed to the other of said upper or lower bands.

11. The sport boot of claim 7 wherein said aperture forms a triangle from a point just posterior of the ankle to a larger area anterior of the ankle on a front edge of said boot body.

12. The sport boot of claim 7 wherein said one or more pistons provide resistance to compression loads.

13. The sport boot of claim 12 wherein said one or more pistons provide no resistance to tension loads.

14. The sport boot of claim 7 further comprising an ice skating blade attached to said boot body.

* * * * *